US005158671A

United States Patent [19]

Cody et al.

[11] Patent Number: 5,158,671

[45] Date of Patent: Oct. 27, 1992

[54] METHOD FOR STABILIZING HYDROISOMERATES

[75] Inventors: Ian A. Cody, Clearwater; Donald T. Eadie, North Vancouver; John M. MacDonald, Sarnia, all of Canada; Glen P. Hamner, Baton Rouge, La.

[73] Assignee: Exxon Research and Engineering Company, Florham Park, N.J.

[21] Appl. No.: 283,659

[22] Filed: Dec. 13, 1988

Related U.S. Application Data

[63] Continuation-in-part of Ser. No. 135,149, Dec. 18, 1987, abandoned.

[51] Int. Cl.[5] ..... C10G 45/00

[52] U.S. Cl. ..... 208/264; 208/97; 208/143; 208/144; 585/738

[58] Field of Search ..... 208/111, 46, 58, 143, 208/144, 95, 97, 264; 585/738, 739, 751, 734

[56] References Cited

U.S. PATENT DOCUMENTS

| | | | |
|---|---|---|---|
| 2,668,790 | 2/1954 | Good et al. | 196/50 |
| 2,668,866 | 2/1954 | Good et al. | 260/683.5 |
| 2,756,183 | 7/1956 | Knox | 196/35 |
| 2,779,713 | 1/1957 | Cole et al. | 196/35 |
| 2,817,693 | 12/1957 | Koome et al. | 260/683.5 |
| 3,268,439 | 8/1966 | Tupman et al. | 208/112 |
| 3,308,052 | 3/1967 | Ireland et al. | 208/139 X |
| 3,365,390 | 1/1968 | Egan et al. | 208/60 |
| 3,486,993 | 12/1969 | Egan et al. | 208/58 X |
| 3,530,061 | 9/1970 | Orkin et al. | 208/60 |
| 3,551,325 | 12/1970 | Rausch | 208/89 |
| 3,629,096 | 12/1971 | Divijak | 208/89 |
| 3,852,207 | 12/1974 | Stangeland et al. | 208/58 |
| 3,861,005 | 1/1975 | Steinmetz et al. | 208/111 |
| 3,870,622 | 3/1975 | Ashton et al. | 208/93 |
| 3,876,522 | 4/1975 | Campbell et al. | 208/58 |
| 3,915,843 | 10/1975 | Franck et al. | 208/112 |
| 3,979,279 | 9/1976 | Yan | 208/264 |
| 4,162,962 | 7/1979 | Stangeland | 208/58 |
| 4,263,127 | 4/1981 | Rausch | 208/58 |
| 4,394,251 | 7/1983 | Miller | 208/111 |
| 4,428,819 | 1/1984 | Shu et al. | 208/46 |
| 4,627,908 | 12/1986 | Miller | 208/58 |
| 4,673,487 | 6/1987 | Miller | 208/143 X |

FOREIGN PATENT DOCUMENTS

| | | | |
|---|---|---|---|
| 700237 | 12/1964 | Canada | 585/751 |
| 823010 | 11/1959 | United Kingdom | 585/749 |
| 951997 | 3/1964 | United Kingdom . | |
| 1065205 | 12/1965 | United Kingdom . | |
| 1381004 | 1/1975 | United Kingdom . | |
| 1460476 | 1/1977 | United Kingdom . | |
| 1493928 | 11/1977 | United Kingdom . | |
| 1499570 | 2/1978 | United Kingdom . | |

*Primary Examiner*—Curtis R. Davis
*Attorney, Agent, or Firm*—Joseph J. Allocca

[57] ABSTRACT

A method is described for rendering total liquid product hydroisomerates daylight stable and improving their oxidation stability, which method involves treating the hydroisomerate total liquid product with a Group VIII metal on refractory metal oxide catalyst or Group VIII metal on halogenated refractory metal oxide catalyst under mild conditions, which conditions are a temperature in the range of 170° to 270° C., a pressure in the range of 300 to 1500 psi $H_2$, 0.25 to 10 v/v/hr and 500 to 10,000 SCF/B,$H_2$.

6 Claims, 2 Drawing Sheets

FEED
SLACK WAX
1
2
HYDROTREATER
3
4
2 STAGE HYDROISOMERIZATION
HI TEMP
5
6
LOW TEMP
6A
7
6B
VAC. FLASH
370° C-
8
9
DEWAXER
10
BROAD CUT
5.5-6.0 cSt
140+ VI
11
BASESTOCK
WAX
12
RECYCLE
12A
12B
600 N

METHOD FOR STABILIZING HYDROISOMERATES

CROSS REFERENCE TO RELATED TO COPENDING APPLICATION

This is a continuation-in-part application of copending U.S. Ser. No. 135,149, filed Dec. 18, 1987, and now abandoned.

DESCRIPTION OF THE INVENTION

Oils in the lube boiling range produced by the hydroisomerization of waxes which oils are suitable for use as lube oil base stocks or blending stocks exhibit unacceptable levels of daylight stability and oxidation stability. It has been discovered that such oils can have their daylight and oxidation stability significantly improved by treating such oils under mild conditions over catalyst comprising Group VIII on supports or Group VIII on halogenated supports. The Group VIII metal component is preferably platinum. The catalysts of choice are selected from Group VIII on halogenated alumina or material containing alumina support, preferably alumina or material consisting predominantly (i.e. >50%) of alumina catalysts, preferably Group VIII on fluorided or chlorinated support, more preferably platinum on fluorided alumina support, most preferably platinum on fluorided $\gamma$ alumina catalyst. These preferred catalysts are preferred hydrosomerization catalysts in which service they are employed under moderate to severe operating conditions.

Slack wax containing from 0% to 25% oil coming from the dewaxing of conventional petroleum crude oils is subjected to hydrotreating over conventional hydrotreating catalyst so as to reduce the sulfur and nitrogen content levels of the wax. This hydrotreating is necessary so as to avoid deactivation of the typical Group VIII on halogenated refractory metal oxide isomerization catalyst. If other, less sensitive isomerization catalysts, such as combination Group VI-Group VIII metal on refractory metal oxide catalysts are used, since such catalysts are usually sulfided prior to use, the need for prehydrotreating is lessened, if not eliminated. In such an instance, however, the feed from an isomerization unit utilizing such a catalyst would have to be treated to remove sulfur and/or nitrogen prior to being contacted with the Group VIII metal on refractory metal oxide or Group VIII metal on halogenated refractory metal oxide catalyst used in the present invention in the mild hydrorefining step following isomerization.

The total liquid product of isomerized slack wax from the isomerization unit is then contacted with the Group VIII metal on refractory metal oxide catalyst or Group VIII on halogenated refractory metal oxide catalyst under mild hydrorefining conditions, which step is followed by a subsequent fractionation into various cuts boiling in the different lube basestock boiling ranges, dewaxing and final fractionation. While these steps can be practiced in different sequences it is preferred that the total liquid product from the isomerization unit be subjected to the herein described mild hydrorefining. It was unexpected that the mild hydrorefining can effectively treat this total liquid product since in the past it had been thought necessary to conduct such hydrofinishing procedures on fractions of oils and not on broad cuts of oils.

While it has been found that fractionated isomerized wax products can be hydrofined it has also been unexpectedly discovered that unfractionated isomerized wax product, the total liquid product from the isomerization unit can be hydrofined under mild conditions to produce a material of improved daylight stability.

DETAILED DESCRIPTION OF THE INVENTION

Figure 1:
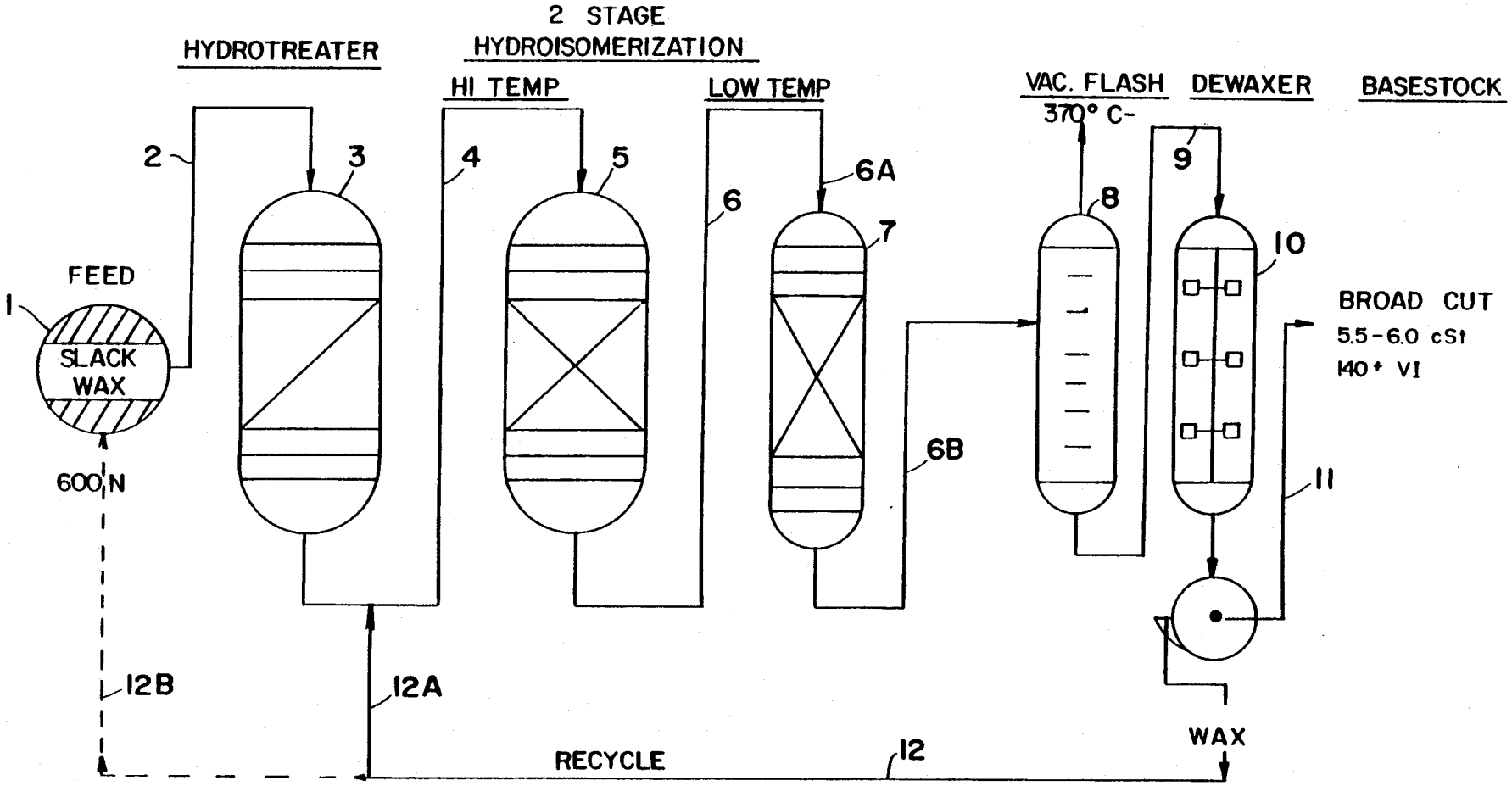
FIG. 1 is a schematic of an overall wax isomerization process utilizing a light slack wax feed and including the mild condition second stage hydrotreating of the present invention.

In the present invention it has been discovered that lube oil base stocks or blending stock oils made by the isomerization of slack waxes can have their daylight stability markedly improved by a process comprising contacting the total liquid product from the isomerization unit with a Group VIII metal on refractory metal oxide support catalyst or Group VIB-Group VIII metal on halogenated refractory metal oxide hydroisomerization catalyst under mild conditions. This mild condition hydrofinishing is performed at a temperature of about 170° C. to 270° C., preferably about 180° to 220° C., a flow velocity of 0.25 to 10 V/V/hr, preferably 1 to 4 V/V/hr, a pressure of from 300 to 1500 psi $H_2$, preferably 500 to 1000 psi $H_2$ and a hydrogen gas rate of 500 to 10,000 SCF/bbl, preferably 1000 to 5000 SCF/bbl. Temperatures at the high end of the range should be employed only when similarly employing pressures at the high end of their recited range. Temperatures in excess of those recited may be employed if pressures in excess of 1500 psi are used, but such pressures may not be practical or economic.

In conjunction with the isomerization step any necessary hydrotreating of the slack wax feed is performed employing commercial catalyst, such as Co/Mo-Ni/Mo on alumina, under standard commercially accepted conditions, e.g., temperature of 320° C. to 400° C., space velocity of 0.1 to 2.0 v/v/hr, pressure of from 500 to 3000 psig $H_2$, and gas rates of from 500 to 5000 SCF/B.

Isomerization is conducted over a catalyst containing a hydrogenating metal component typically one from Group VI or Group VIII or mixtures thereof, preferably Group VIII, more preferably noble Group VIII most preferably platinum on a halogenated refractory metal oxide support. The catalyst typically contains from 0.1–5.0 wt. % metal, preferably 0.1 to 1.0 wt. % metal, most preferably 0.2–0.6 wt. % metal. The refractory metal oxide support is typically a transition e.g. gamma or eta alumina and the halogen is most usually fluorine. Isomerization is accomplished under moderate to high temperature conditions of 270° C. to 400° C., preferably 300° C. to 360° C. Space velocity ranges from 0.10 to 10 v/v/hr, preferably 1.0 to 2.0 v/v/hr. Pressure ranges from 500 to 3000 psi $H_2$, preferably 1000 to 1500 psi $H_2$. Hydrogen gas rate ranges from 1000 to 10,000 SCF/B. Moderate levels of conversion of wax to isomerate are preferred. Conversions to a level such that 25–40% unconverted wax remains in the 370° C.+ fraction sent to the dewaxer, preferably 25–35% unconverted wax remains in the 370° C.+ fraction sent to the dewaxer are preferred, as is taught in copending application U.S. Ser. No. 283,664, filed Dec. 13, 1988, now U.S. Pat. No. 5,059,299.

As previously stated, if the isomerization catalyst is of the family which is normally presulfided before use, the prehydrotreating step can be dispensed with, but the isomerized wax product would still have to be freed of $H_2S$ and $NH_3$ prior to being contacted with the second stage catalyst. This could be done by flashing or stripping of the product to remove $H_2S$ and $NH_3$.

Preferred catalysts are the subject of copending application U.S. Ser. No. 283,709, filed even date herewith, now U.S. Pat. No. 4,959,337, which is a continuation-in-part of U.S. Ser. No. 134,795, filed Dec. 18, 1987 in the names of Cody, Sawyer, Hamner and Davis. The use of these catalysts for the production of a lube oil base stock or blending stock by the isomerization of wax is the subject of copending application U.S. Ser. No. 283,665, filed even date herewith, now U.S. Pat. No. 4,929,795, which is a continuation-in-part of U.S. Ser. No. 134,952, filed Dec. 18, 1987 in the names of Cody, Hamner and Schorfheide.

The catalyst of U.S. Ser. No. 283,709, filed Dec. 13, 1988, now U.S. Pat. No. 4,959,337, contains a hydrogenation metal component which is a Group VIII noble metal or mixture thereof, preferably noble Group VIII metal, most preferably platinum on a fluorided alumina or material containing alumina, preferably alumina or material consisting predominantly (i.e. >50%) of alumina, most preferably gamma or eta alumina wherein said catalyst in its as introduced to waxy feed form is characterized by possessing (1) a hydrate level of 60 or less, preferably 10 to 60 determined as the relative amount of hydrate represented by a peak in the X-ray diffraction (XRD) pattern at $2\theta=5.66$ Å when a hydrate level of 100 corresponds to the XRD peak height exhibited by a standard material constituting 0.6 wt % Pt on 150 $m^2g$ $\gamma$ alumina containing 7.2 wt % F wherein the fluorine has been deposited using an aqueous solution containing a high concentration of HF, i.e. 10 wt % and greater, preferably 10 to 15 wt % HF and the material dried at 150° C. for 16 hours; (2) a surface nitrogen content N/Al ratio of 0.01 to less, preferably 0.007 or less, most preferably 0.004 or less, as determined by X-ray photoelectron spectroscopy (XPS); (3) a bulk fluorine concentration of about 2 to 10 wt % and (4) a surface fluorine concentration, defined as the amount of fluorine present in a layer extending from the surface to a depth of 1/100 inch of less than 3 wt %, preferably less than 1 wt %, most preferably less than 0.5 wt % provided that the surface fluoride concentration is less than the bulk fluoride concentration.

The fluoride content of the catalyst can be determined in a number of ways.

One technique analyzes the fluorided catalysts using oxygen combustion methodology which is well established in the literature. Approximately 8-10 mgs of sample is mixed with 0.1 g benzoic acid and 1.2 gms of mineral oil in a stainless steel combustion capsule which is mounted in a 300 mL. Parr oxygen combustion bomb. The "sample" is purged of air and subsequently combusted under 30 Atms of pure oxygen. Combustion products are collected in 5 mL. of deionized water. Once the reaction has gone to completion (about 15 minutes), the absorbing solution is quantitively transferred and made to fixed volume.

Fluoride concentration of the sample is determined by ion chromatography analysis of the combustion product solution. Calibration curves are prepared by combusting several concentrations of ethanolic KF standards (in the same manner as the sample) to obtain a 0-10 ppm calibration range. Fluoride concentration of the catalyst is calculated on an ignition-loss-free-basis by comparison of the sample solution response to that of the calibration curve. Ignition loss is determined on a separate sample heated to 800 degrees F. for at least 2 hours. Ion chromatographic analysis uses standard anion conditions.

Another procedure employs the use of fluoride distillation with a titrimetric finish. Fluorides are converted into fluorosilicic acid ($H_2SiF_6$) by reaction with quartz in phosphoric acid medium, and distilled as such using super heated steam. This is the Willard-Winter-Tananaev distillation. It should be noted that the use of super heated, dry (rather than wet) steam is crucial in obtaining accurate results. Using a wet steam generator yielded results 10-20% lower. The collected fluorosilicic acid is titrated with standardized sodium hydroxide solution. A correction has to be made for the phosphoric acid which is also transferred by the steam. Fluoride data are reported on an ignition-loss-free-basis after determination of ignition loss on a sample heated to 400 degree C. for 1 hour.

Another preferred catalyst described in U.S. Ser. No. 283,709, filed Dec. 13, 1988, now U.S. Pat. No. 4,959,337, is a catalyst prepared by a process involving depositing a hydrogenation metal on an alumina or material containing alumina support, calcining said metal loaded support typically at between 350° to 500° C., preferably about 450° to 500° C. for about 1 to 5 hours, preferably about 1 to 3 hours and fluoriding said metal loaded support using a high pH fluorine source solution to a bulk fluorine level of about 8 wt % or less, (i.e. 2 to 8 wt %) preferably about 7 wt % or less, said high pH source solution being at a pH of 3.5 to 4.5 and preferably being a mixture of $NH_4H$ and HF followed by rapid drying/heating in a thin bed or rotary kiln to insure thorough heating in air, an oxygen containing atmosphere or an inert atmosphere to a temperature between about 350° to 450° C. in about 3 hours or less, preferably 375° to 400° C., and holding at the final temperature, if necessary, for a time sufficient to reduce the hydrate content to the aforesaid level (e.g. 1 to 5 hours) or using a low pH fluorine source solution having a pH of less than 3.5 using aqueous solutions of HF or appropriate mixtures of HF and $NH_4F$ to a bulk fluorine level of about 10 wt % or less, (i.e. 2 to 10 wt %) preferably about 8 wt % or less followed by drying/heating in a thin bed or rotary kiln to a temperature of about 350° to 450° C., preferably 375° to 425° C. in air an oxygen containing atmosphere, or an inert atmosphere and holding for 1 to 5 hours. The alumina or alumina containing support material is preferably in the form of extrudates, and are preferably at least about 1/32 inch across the longest cross-sectional dimension. If the low pH prepared catalyst is first charged to a unit, the catalyst must be held at the final activation temperature for longer than 5 hours, preferably longer than 10 hours and preferably at temperature of 400° to 450° C.

The above catalysts typically contain from 0.1 to 5.0 wt % metal, preferably 0.1 to 1.0 wt % metal, most preferably 0.2 to 0.6 wt % metal.

The dried/heated catalyst has a surface nitrogen content N/Al of 0.01 or less by X-ray photoelectron spectroscopy (XPS, preferably an N/Al of 0.007 or less, most preferably an N/Al of 0.004 or less by XPS.

The catalyst following the above recited heating step can be charged to the isomerization reactor and brought quickly up to operating conditions. Alternatively following the above recited heating step the catalyst prepared using the pH 3.5 to 4.5 solution technique can be activated, preferably in pure or plant hydrogen (60 to 70% $H_2$) at 350° to 450° C., care being taken to employ short activation times, from 1 to 24 hours, preferably 2 to 10 hours being sufficient. Long activation times (in excess of 24 hours) have been found to be detrimental to catalyst performance. By way of comparison, catalysts made using solutions of pH less than 3.5 can be activated in pure or plant hydrogen at 350° to 500° C. for from 1 to 48 hours or longer. In fact, if catalysts prepared using solutions of pH less than 3.5 are not heated first, then it is preferred that they be subsequently activated at more severe conditions, i.e. for longer times and/or at higher temperatures. On the other hand, if they are heated first, then moderate activation condition procedures similar to those employed with catalysts made from higher pH solution techniques will suffice.

A typical activation profile shows a profile of 2 hours to go from room temperature with 100° C. with the catalyst being held at 100° C. for 0 to 2 hours then the temperature is raised from 100 to about 350 over a period of 1 to 3 hours with a hold at the final temperature of from 1 to 4 hours. Alternatively the catalyst can be activated by heating from room temperature to the final temperature of 350° to 450° C. over a period of 2 to 7 hours with a hold at the final temperature of 0 to 4 hours. Similar activation can be accomplished by going from room temperature to the final temperature of 350° to 450° C. in 1 hour.

It is possible to dispense with a separate activation procedure entirely (provided the catalyst has been first heated in air). In these instances, the calcined catalyst is simply charged to the reactor, heated to just above the melting point of the wax feed, feed and hydrogen introduced onto the catalyst and thereafter the unit brought quickly up to operation conditions.

Another preferred catalyst is made by the procedure recited in copending application U.S. Ser. No. 283,658, filed even date herewith, now U.S. Pat. No. 4,900,707, which is a continuation-in-part of U.S. Ser. No. 134,698, filed Dec. 18, 1987 in the names of Cody, Hamner, Sawyer and Schorfheide. The use of this particular catalyst for the production of lube base stock and blending stock by the isomerization of wax is the subject of copending application U.S. Ser. No. 283,680, filed even date herewith, now U.S. Pat. No. 4,937,399, which is a continuation-in-part of U.S. Ser. No. 134,697, filed Dec. 18, 1987 in the names of Wachter, Cody, Hamner and Achia. That catalyst comprises a hydrogenating metal on fluorided alumina or material containing alumina support made by depositing the hydrogenation metal on the support and fluoriding said metal loaded support using acidic fluorine sources such as HF by any convenient technique such as spraying, soaking, incipient wetness, etc. to deposit between 2 to 10%, preferably 2 to 8%. Following halogenation, the catalyst is dried, typically at 120° C. and then crushed to expose inner surfaces, the crushed catalyst is double sieved to remove fines and uncrushed particles. This sized catalyst is 1/32 inch and less and typically from 1/64 to 1/32 inch in size across its largest cross-sectional dimension.

The starting particle or extrudate may be of any physical configuration. Thus, particles such as cylinders, trilobes or quadrilobes may be used. Extrudates of any diameter may be utilized and can be anywhere from 1/32 of an inch to many inches in length, the length dimension being set solely by handling considerations. It is preferred that following sizing the particle have a length smaller than the initial extrudate diameter.

Following deposition of the hydrogenation metal and the fluoriding of the particle or extrudate, the particle or extrudate is crushed or fractured to expose inner surfaces.

The crushing is conducted to an extent appropriate to the particle or extrudate with which one is starting. Thus, an extrudate which is 1 foot long and 1/16 inch in diameter would be sized into pieces which range anywhere from 1/64 to 1/32 inch across its longest cross-sectional dimension. Similarly, if the extrudate is only 1/16 inch to begin with it will be enough simply to break it in half, into two 1/32 inch pieces, for example.

Alternatively, one can take a metal loaded support particle which is already about 1/32 inch in size or smaller and fluoride it as described above using HF.

Generally, therefore, the sized material will range in size between about 1/64 to 1/32 inch in size.

The uncalcined catalyst is activated in a hydrogen atmosphere such as pure hydrogen or plant hydrogen containing 60 to 70 vol % $H_2$ by heating to 350° to 500° C., preferably 350° to 450° C. for from 1 to 48 hours or longer. The hydrogen activation profiles previously described may be used here.

This sized catalyst is unexpectedly superior for wax isomerization as compared to the uncrushed particle or extrudate starting material. It has also been discovered that 370° C.+ oil products made using the sized catalyst as compared to the uncrushed or extrudate material starting with wax possessing about 5 to 10% oil exhibit higher VI's than do 370+ oil products made starting with wax possessing 0% oil (on the one hand) and about 20% oil (on the other). Therefore, to produce products having the highest VI one would isomerize wax having from 5 to 15% oil, preferably 7 to 10% oil using the "sized" catalyst produced using HF.

In copending application U.S. Ser. No. 135,032, filed Dec. 18, 1987 in the names of Hamner and Davis, it is taught that an increased yield of lube oil base stock or blending stock can be obtained by using palladium on fluorided alumina as the catalyst.

One desiring to maximize the production of lube oil having a viscosity in the 5.6 to 5.9 cSt/100° C. range should practice the isomerization process under low hydrogen treat gas rate conditions, treat gas rates on the order of 500 to 5000 SCF/bbl, $H_2$, preferably 2000 to 4000 SCF/bbl, $H_2$, most preferably about 2000 to 3000 SCF/bbl, $H_2$, as is taught in copending application U.S. Ser. No. 283,684, filed even date herewith.

The isomerized wax material is then subjected to second stage catalyst using a Group VIII metal on refractory metal oxide catalyst or Group VIII metal on halogenated refractory metal oxide catalyst. The halogenated catalyst can be the same or different than the Group VIII metal on halogenated refractory metal oxide catalyst used in the prior isomerization reactor. If the same catalyst is used, the process can be run in blocked sequence, the reactor first used to produce isomerate by being run at severe conditions with the isomerate going to tankage, the stored isomerate being subsequently recycled through the unit now run under mild conditions to remove trace quantities of polynuclear aromatics and other constituents detrimental to daylight and oxidation stability, but which conditions are not sufficient to effect further isomerization of the hydrocarbon components. This second stage zone is run at a temperature of about 170° C. to 270° C., preferably 180° C. to 220° C., a flow velocity of 0.25 to 10 v/v/hr, preferably 1 to 4 v/v/hr, a pressure of from 300 to 1500 psi $H_2$, preferably 500 to 1000 psi $H_2$, and a hydrogen gas rate of 500 to 10,000 SCF/B, preferably 1000 to 5000 SCF/B. Higher temperatures may be employed if pressures in excess of 1500 psi are used, but such high pressures may not be practical.

Following isomerization and the mild second stage treatment described herein the isomerate is fractionated into a lubes cut and fuels cut, the lubes cut being identified as that fraction boiling in the 330° C.+ range, preferably the 370° C.+ range and even higher. This lubes fraction is then dewaxed to a pour point of about −21° C. or lower. Dewaxing is accomplished by techniques which permit the recovery of unconverted wax, since in the process of the present invention this unconverted wax is recycled to the isomerization unit. It is preferred that this recycle wax be recycled to the main wax reservoir and be passed through the hydrotreating unit to remove any quantities of entrained dewaxing solvent which solvent could be detrimental to the isomerization catalyst. Alternatively, a separate stripper can be used to remove entrained dewaxing solvent or other contaminants. Since the unconverted wax is to be recycled dewaxing procedures which destroy the wax such as catalytic dewaxing are not recommended. Solvent dewaxing is utilized and employs typical dewaxing solvents. Solvent dewaxing utilizes typical dewaxing solvents such as $C_3$–$C_6$ ketones (e.g. methyl ethyl ketone, methyl isobutyl ketone and mixtures thereof), $C_6$–$C_{10}$ aromatic hydrocarbons (e.g. toluene), mixtures of ketones and aromatics (e.g. MEK/toluene), autorefrigerative solvents such as liquefied, normally gaseous $C_2$–$C_4$ hydrocarbons such as propane, propylene, butane, butylene and mixtures thereof, etc. at filter temperature of −25° to −30° C. As is taught in the previously referenced copending application U.S. Ser. No. 283,664, filed even date herewith, now U.S. Pat. No. 5,059,299 the preferred solvent to dewax the isomerate, especially isomerates derived from heavier waxes (e.g. Bright Stock waxes) under miscible conditions and thereby produce the highest yield of dewaxed oil at a high filter rate is a mixture of MEK/MIBK (20/80 v/v) used at a temperature in the range −25 to −30° C. Pour points lower than −21° C. can be achieved using lower filter temperatures and other ratios of said solvent but a penalty is paid due to operation under immiscible conditions, the penalty being lower filter rates. Further and as also taught in U.S. Ser. No. 283,664, when dewaxing isomerate made from a microwax, e.g. Bright Stock slack wax it has been found to be preferred that the fraction of the isomerate which is sent to the dewaxer is the "broad heart cut" identified as the fraction boiling between about 330° to 600° C., preferably about 370° to 580° C. after such fractionation the fraction sent to the dewaxer has about 40% and less unconverted wax. The heavy bottoms fraction contains appreciable wax and can be recycled to the isomerization unit directly. However, if any hydrotreating or deoiling is deemed necessary or desirable then the fractionation bottoms are recycled by being sent first to the fresh feed reservoir and combined with the wax therein. As an alternative the isomerate from the second stage catalyst zone can be fractionated into narrow cuts and each cut individually dewaxed.

Figure 2:
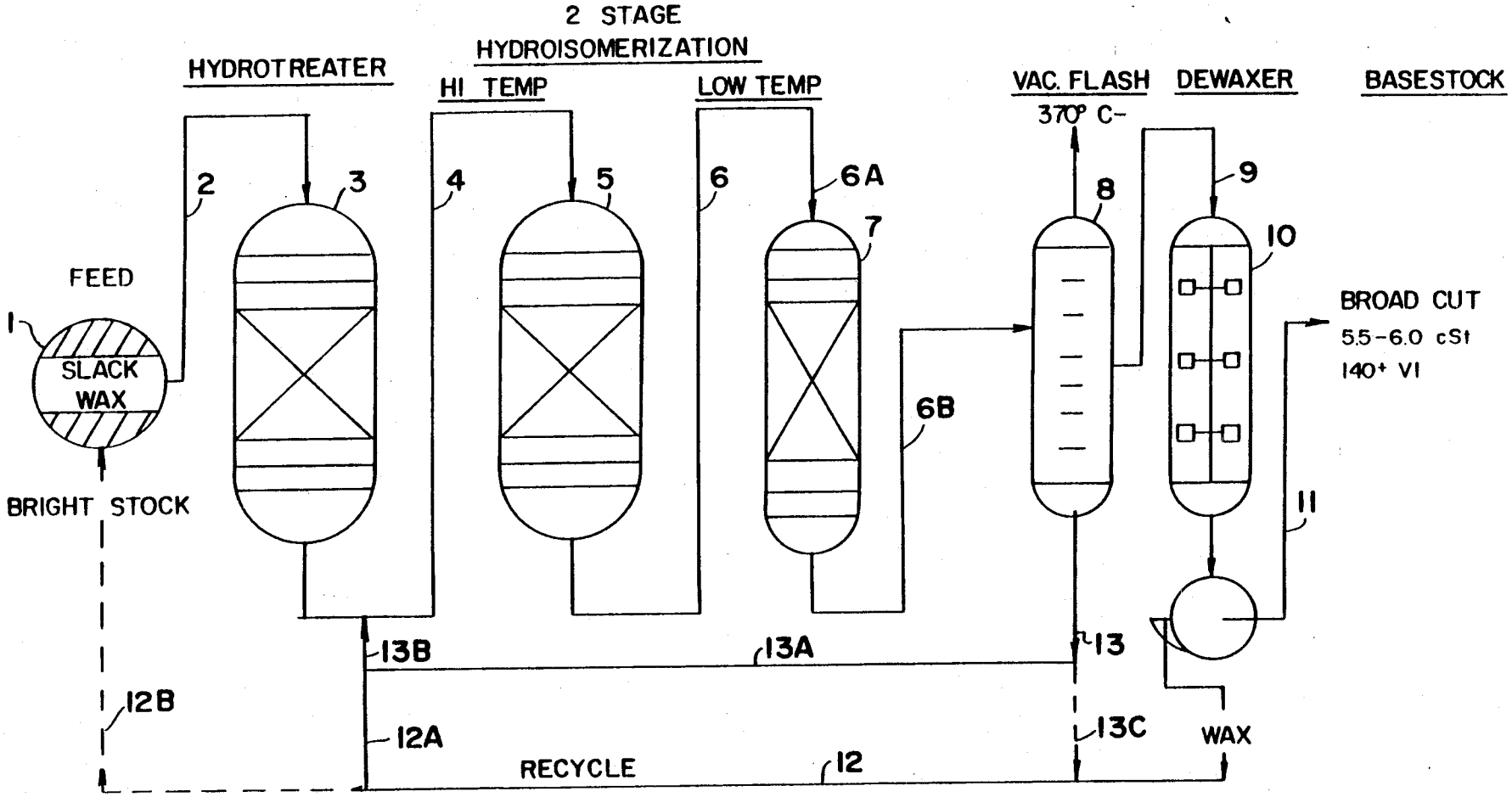
FIG. 2 is a schematic of an overall wax isomerization process utilizing a heavy micro crystalline wax feed, including fractionator bottoms recycle and employing the mild condition second stage hydrotreating of the present invention.

FIGS. 1 and 2 present schematic representations of preferred embodiments of the wax isomerization process.

In FIG. 1 slack wax feed derived from for example a lighter oil such as 600N oil or lighter is fed from the reservoir (1) to a hydrotreater (3) via line 2 wherein heteroatom compounds are removed from the wax. This hydrotreated slack wax is then fed via line 4 to the isomerization unit (5) after which the total liquid product is fed first via lines 6 and 6A to a low temperature, mild condition second stage treating unit (unit 7) wherein the TLP is contacted with the isomerization catalyst or simply a noble Group VIII metal on aluminum catalyst to produce a stream which is then sent via line 6B to the fractionator tower (unit 8). The lube stream boiling in the 370° C.+ range is then forwarded via line 9 to the solvent dewaxer (unit 10) for the separation of waxy constituents therefrom, the dewaxed oil fraction being recovered via line 11 and forwarded to other conventional treatment processes normally employed on base stock or blending stock oils. The recovered wax is recycled either directly to the slack wax stream being fed to the isomerization unit or it is recycled to the was reservoir (1) via line 12B for passage through the hydrotreater prior to being recycled to the isomerization unit.

In FIG. 2 the wax processing stream is much like that of FIG. 1, the main difference being that FIG. 2 represents the scheme for handling heavier slack wax feeds, such as a wax feed derived from Bright Stock oil. In such a case the wax from reservoir 1 is fed via line 2 to the hydrotreater (3) prior to being sent via line 4 to the isomerization unit (unit 5) after which it is fed via lines 6 and 6A to a low temperature mild condition second stage treating unit (unit 7) wherein it is contacted with a further change of isomerization catalyst or simply noble Group VIII metal on alumina and fed via line 6B to the fractionator tower (unit 8). In the fractionator tower the isomerate made using the heavy wax is fractionated into a light fraction boiling in the 370° C.− (a fuels cut) a lube cut boiling in the 370° C.+ range and a bottoms fraction boiling in the 580° C.+ range. The lubes fraction, a broad cut boiling in the 370° C. to 580° C. range is sent via line 9 to the drawer (unit 10) as previously described. The 580° C.+ bottoms fraction contains appreciable wax and is recycled via lines 13, 13A, 13B and 4 to the isomerization unit (5). This bottoms fraction optionally can be combined via lines 13 and 13C with the wax in line 12 recovered from the dewaxing unit (10) in which case the total recycled stream can be fed directly to the isomerization unit via lines 12A, 13B and 4 or it can be sent to the wax reservoir (1) via line 12B for treatment of the hydrotreater prior to being fed to the isomerization unit.

LIST OF CATALYSTS USED

In the following examples, the following catalysts were used either as first stage isomerization catalyst and/or as second stage mild condition hydrofinishing catalyst. Which catalyst was used in what service is identified in each example.

Catalyst A: Commercially available platinum on γ-alumina reforming catalyst comprising 0.62% Pt on γ-alumina and containing about 1% chlorine.

Catalyst B: Platinum on fluorided γ-alumina made by soaking a commercially available Pt/γ-$Al_2O_3$ base (Catalyst A) in $NH_4F/HF$ solution having a pH of about 4. The soaked material was washed, then dried and then heated for two hours at 400° C. in air. The catalyst was analyzed and had a bulk fluorine content of 7.0%, platinum content of 0.62 wt %, surface N/Al ratio (by X-ray photo spectroscopy) of 0.0037. The catalyst was activated by heating to 450° C. in $H_2$ at 50 psi in the following manner: room temperature to 100° C. in two hours, hold at 100° C. for one hour; heat from 100° C. to 400° C. in three hours, hold at 450° C. for four hours.

Catalyst C: Platinum on fluorided γ-alumina made by soaking a commercially available $Pt/\gamma\text{-}Al_2O_3$ base (Catalyst A) in $NH_4F/HF$ solution made up to a pH of about 4. The soaked material was washed, then dried then heated for two hours at 400° C. in air. The catalyst was analyzed and had a bulk fluorine content of 6.9 wt %, platinum content of 0.62 wt %, surface N/Al ratio (by XPS) of 0.0040. This catalyst was activated by heating to 350° C. in $H_2$ at 50 psi in the following manner; room temperature to 100° C. in two hours, hold at 100° C. for one hour; heat from 100° C. to 350° C. in two hours, hold at 350° C. for one hour.

Catalyst D: Platinum on fluorided γ-alumina made by soaking a commercially available $Pt/\gamma\text{-}Al_2O_3$ base (Catalyst A) in 10% HF. The soaked material was washed and dried at 150° C. in air. The catalyst was analyzed and had a bulk fluoride content of 8.0%, platinum content of 0.62 wt %. The catalyst was activated by heating to 400° C. in $H_2$ at 300 psi in the following manner; room temperature to 100° C. at 35° C. per hour, hold at 100° C. for 6 hours, heat from 100° C. to 250° C. at 10° C. per hour, hold at 250° C. for 12 hours; heat to 400° C. at 10° C. per hour; hold at 400° C. for 3 hours.

Catalyst E: Commercially available platinum on γ-alumina comprising 0.5% Pt on γ-alumina from which halogen had been removed and activated by heating in 40 psi $H_2$ as follows: room temperature to 100° C. in 2 hours, hold at 100° C. for 1 hour; heat to 350° C. over 2 hours, hold at 350° C. for 1 hour.

Slack Wax Hydrotreating

In the following examples raw slack waxes from the dewaxing of petroleum oils were hydrotreated to remove polar materials, as well as heteroatomic compounds (sulfur and nitrogen containing compounds) which would deactivate the platinum on fluorided alumina hydroisomerization catalysts. Any conventional hydrotreating catalyst can be used, e.g., Cyanamid's HDN-30; Katalco's NM-506; Ketjen's KF-840; etc. The prime processing targets for the hydrotreated material are a sulfur content of about 10 ppm or less and a nitrogen content of 1 ppm or less. In the present Example Ketjen KF-840 was used in the form of 1/20 inch quadrilobes. The catalyst, as received from the manufacturer, had 4% NiO and 19.5% $MoO_3$ on an alumina base, and had a surface area of 180 $m^2$/gram, with an average pore volume of 0.35 cc/g, and an average pore radius of 38 Å. Twelve liters of this catalyst was packed into a tubular fixed bed 189 cm long and 9.9 cm in diameter and sulfided by exposure to $H_2S$ in hydrogen and a sulfur containing vacuum distillate. The hydrotreating unit can be run in either up flow or down flow mode. Two different slack waxes were hydrotreated, a Western Canadian 600N slack wax, and an Augusta Bright Stock slack wax. Typical properties of each feed are given below in Table 1.

TABLE 1

| Slack Wax Source | 600 Neutral | Bright Stock |
|---|---|---|
| Gravity, °API | 36.2 | 31.5 |
| Viscosity, 100° C., cSt | 6.93 | 18.25 |
| Sulphur, wppm | 710 | 2290 |
| Total Nitrogen, wppm | 13 | 120 |
| Basic Nitrogen, wppm | 6 | 34 |
| Asphaltenes, Wt. % | — | 0.14 |
| Dewaxing Aid, Wt. % | — | 0.17 |
| GC Distillation, initial °C. | 372 | 367 |
| 1%, °C. | 384 | 430 |
| 5%, °C. | 416 | 497 |
| 50%, °C. | 488 | 606 |
| 93%, °C. | 538 | — |
| Oil Content, Wt. % | 19.6 | 12.9 |
| Aromatic Content, Wt. % | 4 | 6 |

The above are representative assays of typical samples of the identified slack waxes.

In point of fact significant changes, especially in sulphur and nitrogen contents are seen in different samples of these slack waxes over time reflecting variations between various crude samples and processing severities.

The 600N slack wax was hydrotreated in an up-flow mode at 0.5 v/v/hr, 1000 psig hydrogen pressure and a gas treat rate of 1500 SCF $H_2$/B. For the first 2080 hours of operation reaction temperature was held at 320° C. and thereafter at 330° C. The slack wax sulphur contents ranged from about 0.073 weight percent to 0.113 weight percent and nitrogen content ranged from 12 to 17 wppm. Periodic analysis of the hydrotreated wax showed that sulphur contents were consistently 4 wppm and lower, while nitrogen contents were always 2 wppm or less.

The Bright Stock slack waxes feeds having different oil contents were hydrotreated in an up-flow mode at 380° C., 1000 psig hydrogen pressure and 1500 SCF$H_2$/B treat gas rate. The space velocity was varied from 0.42 to 0.5, in order to obtain the desired sulfur and nitrogen reduction. Inspections of the hydrotreated wax feeds used in the examples are given below in Table 2.

TABLE 2

Slack Wax Inspection Following Hydrotreating

| Wax Source | 600N | Bright A | Stock B |
|---|---|---|---|
| Gravity, °API @ 15° C. | 36.3 | 35.7 | 34.1 |
| Viscosity, 100° C., cSt | 6.77 | 11.05 | 10.52 |
| Sulphur, wppm | 2 | 2 | 1 |
| Nitrogen, wppm | <1 | <1 | <1 |
| Asphaltenes, Wt. % | — | 0.05 | |
| Dewaxing Aid, Wt. % | — | 0.00 | |
| GC Distillation, Initial, °C. | 367 | 189 | 211 |
| 1%, °C. | 378 | 211 | 230 |
| 5%, °C. | 412 | 313 | 307 |
| 50%, °C. | 482 | 366 | 553 |
| 95%, °C. | 547 | — | — |
| Oil Content, Wt. % | 19.5 | 17.1 | 23.6 |
| Aromatic Content, Wt. % | 2 | 4 | — |

Hydroisomerization Operation

The slack waxes from the hydrotreater freed of $H_2S$ and $NH_3$ were isomerized over various of the $Pt\text{-}F/Al_2O_3$ catalysts described earlier. The 370° C.+ dewaxed oil yields reported herein below were determined by "Standard Test Method for Solvent Extractable on Petroleum Waxes" ASTM Test D-3235-73 (Reapproved 1983).

(A) The hydrotreated Bright Stock slack wax (B) was isomerized at 320° C., 0.89 v/v/hr space velocity, 1000 psi ($H_2$) pressure and 5000 SCF/bbl, $H_2$, gas rate over a 200 cc charge of Catalyst B. The hydroconversion was conducted upflow mode and operated at a mass velocity was 160 pounds per hour/square foot (i.e. low mass velocity).

The isomerate total liquid product (TLP) produced at conditions that gave 37.5 wt % conversion to 370° C.− when dewaxed at standard conditions gave a 370° C.+ dewaxed oil yield of 48.5 wt % (Based on Feed).

(B) The hydrotreated Bright Stock slack wax (B) was isomerized at low mass velocity at 325°-330° C. at 0.89 v/v/h, 1000 psig, $H_2$, 5000 SCF $H_2$/bbl over a 200 cc charge of Catalyst C. The isomerate Total Liquid Product (TLP) produced at conditions that gave 20.6 wt % conversion to 370° C.− when dewaxed at standard conditions gave the a 370° C.+ dewaxed oil yield 41.7 wt % (based on feed).

(C) The hydrotreated Bright Stock slack wax (A) was isomerized over a 3500 cc charge of Catalyst D in a series of six reactors at high mass velocity conditions (2000 pounds/hr/square foot) at two sets of isomerization conditions: (i) 313° C. at 0.5 v/v/hr., 1000 psi, 5000 SCF $H_2$/bbl and (ii) 325° C. at 1.0 v/v/hr., 1000 psi, 5000 SCF $H_2$/bbl yielding an isomerate blend (ii/i of 80/20) of product. Conversion (based on the blend) to 370° C.− was 25.1 wt %. The 370° C.+ dewaxed at standard conditions gave a dewaxed oil yield (based on blend) of 50.0 wt %.

(D) The hydrotreated 600N slack wax was isomerized over 3500 cc charge of Catalyst D in a series of six (6) reactors at high mass velocity conditions, 2000 pounds/hr/sq.ft. at 326° C., 1000 psi, 5000 SCF $H_2$/bbl, 1.0 v/v/hr. Conversion to 370° C.− was 25.8. The yield of 370° C.+ dewaxed oil was 51.0 wt % (based on feed).

DEWAXED BASE OIL PROPERTIES

Base oils were prepared from the total liquid product coming from the isomerization zone by fractionating said TLP into various lube fractions and dewaxing said lube fraction to a pour point of −21° C.

1. The 600N slack wax isomerate (D) TLP was topped to 370° C.+ and this lube oil fraction dewaxed to a pour point of −21° C. by batch dewaxing using 100% MIBK solvent at a dilution rate of 4 volumes of solvent to one volume of oil at a −26° C. filter temperature.

2. Bright Stock isomerate (B) was topped to 370° C.+ and dewaxed to −21° C. by batch dewaxing using 100% MIBK solvent at 4 volumes of solvent to 1 volume of oil at −26° C. filter temperature.

3. Bright Stock isomerate (C) was vacuum distilled to give a 370°-582° C. heart-cut and dewaxed at −27° C. using 15/85 MEK/MIBK at 4 volumes of solvent to 1 volume of oil to a −21° C. pour. This dewaxed oil was then vacuum fractionated into 2% cuts at the front and back end of the desired heart-cut in order to allow blending to a final viscosity of 4.5 cSt at 100° C.

4. As in 3 (above) but the incremental cuts were blended to final dewaxed oil viscosities ranging from 8.0 to 8.3 cSt at 100° C.

5. As in 3 (above) but using Bright Stock isomerate (A) the incremental cuts from the "A" product distillation were blended to a final dewaxed oil viscosity of 8.0 cSt at 100° C.

In the following examples daylight stability was determined on the products from 1 through 5 (above) by exposing 5 ml samples in the presence of air continuously in a light box apparatus in which the lamp used was an Excella fluorescent tube from Sunburst Electric which simulated the intensity and frequency range of actual solar radiation. Samples were rated daily on the degree of haze, floc and sludge formation as to time exposed to air and radiation.

EXAMPLE 1

The dewaxed base stock oils above 1-5 were evaluated for daylight stability and found to exhibit the following:

TABLE 3

| Dewaxed Base Oil # | Daylight Stability |
|---|---|
| 1 | Light haze, 48 hrs; distinct haze 96 hrs. |
| 2 | Haze/sludge ≦24 hours |
| 3 | Haze/sludge ≦24 hours |
| 4 | Haze/sludge ≦24 hours |
| 5 | Haze/sludge ≦24 hours |

It is seen that none of these dewaxed isomerate base oil products exhibit acceptable daylight stability since conventional lube base oils normally have daylight stability in excess of 10 days.

EXAMPLE 2

Hydrofinished Dewaxed Base Oils

Base oils 3 and 4 were hydrofinished over sulfided KF-840 (Ni-Mo/$Al_2O_3$) at 300° C. at 500 psi, 500 SCF $H_2$/bbl and 1 v/v/hr. These hydrofinished base oils were evaluated for daylight stability and found to exhibit the following somewhat improved but still unacceptable daylight stabilities:

TABLE 4

| KF-840 Hydrofined Dewaxed Base Oil | Daylight Stability |
|---|---|
| 3 | Haze/sludge, 50 hours |
| 4 | Haze/sludge, 100 hours |

EXAMPLE 3

Hydrofinished Base Oils (Pt/F-$Al_2O_3$ Catalyst)

Dewaxed base oils 3, 4 and 5 were hydrofinished over Pt/F-$Al_2O_3$ Catalyst B under a number of conditions (recited in Table 4). The hydrofinished base oils were evaluated for daylight stability and found to exhibit the following:

TABLE 5

| | Dewaxed Base Oil | | | | | |
|---|---|---|---|---|---|---|
| Feed | 3 | | | 4* | | 5 |
| Catalyst | B | | | B | | B |
| | Hydrofinishing Conditions | | | | | |
| Temperature °C. | 160 | 180 | 200 | 200 | 225 | 200 |
| Pressure, psi $H_2$ | 1000 | 1000 | 1000 | 1000 | 1000 | 1000 |

TABLE 5-continued

| | Dewaxed Base Oil | | | | | |
|---|---|---|---|---|---|---|
| Feed | | 3 | | 4* | | 5 |
| Catalyst | | B | | B | | B |
| Space Velocity v/v/hr | 0.9 | 0.9 | 2.0 | 0.9 | 0.9 | 0.9 |
| Gas Rate, SCF $H_2$/B | 2270 | 2270 | 2270 | 2270 | 2270 | 5000 |
| Inspection of Hydrofinished Oil | | | | | | |
| Time to Form a Distinct Haze, days | 3 | 6 | 13 | 10 | 8 | >60 |

*Prior to hydrofinishing feed 4 had already developed a sludge which was filtered out prior to hydrofinishing and evaluation.

When dealing with isomerate fractions, it is seen that hydrofinishing under higher treat gas rates gave a product of improved stability.

In the following examples 4 to 9, stabilized unfractionated total liquid isomerate products were hydrofinished under various conditions and over various catalysts and subsequently evaluated for daylight stability.

EXAMPLE 4

600N slack wax isomerate total liquid product (TLP), from the hydroisomerization (d) operation with catalyst D ($Ni/Mo/Al_2O_3$) was hydrofinished over KF-840 (conditions recited below). The hydrofinished material was fractionated to obtain the 370° C.+ fraction for subsequent dewaxing to −21° C. pour using 100% MIBK solvent at a 4/1 solvent to oil dilution ratio and −26° C. filter temperature. This dewaxed oil fraction was evaluated for daylight stability.

TABLE 6

| | | |
|---|---|---|
| Hydrofinishing Conditions | | |
| Temperature °C. | 200 | 200 |
| Pressure, psi, $H_2$ | 1000 | 500 |
| Gas Rate, SCF/B, $H_2$ | 2500 | 2500 |
| Space Velocity v/v/hr | 2.0 | 2.0 |
| Inspection of Hydrofinished Oil | | |
| Time for dewaxed to form a slight Haze (days) | 3 | 3 |
| Time for Dewaxed Oil to form a Distinct Haze (days) | 10 to 13 | 10 to 13 |

From the above it is apparent that treating a total liquid product with a conventional hydrofinishing catalyst produces a final material which exhibits unacceptable performance characteristics as regards daylight stability.

EXAMPLE 5

The 600N slack wax isomerate (TLP), feed D and Bright Stock slack wax isomerate (TLP) feed B were hydrofinished over Pt/alumina, catalyst E (previously described), under the conditions recited below. The hydrofinished materials were fractioned into 370° C.+ fraction and dewaxed to −21° C. pour as recited in Example 4. The dewaxed fraction were evaluated for daylight stability (Table 7).

TABLE 7

| Hydroisomerization (TLP) Feed | D | | B |
|---|---|---|---|
| Hydrofinishing Conditions: | | | |
| Temperature °C. | 200 | 200 | 200 |
| Pressure, psi $H_2$ | 1000 | 500 | 1000 |
| Gas Rate, SCF/B, $H_2$ | 2500 | 2500 | 2500 |
| Space Velocity v/v/hr | 2.0 | 2.0 | 0.9 |

TABLE 7-continued

| Hydroisomerization (TLP) Feed | D | | B |
|---|---|---|---|
| Inspection of Hydrofinished Dewaxed Oil | | | |
| Time to Form a Slight Haze, days | 16 | 16 | 16 |

It is seen that hydrofinishing a total liquid product over a platinum on alumina catalyst produces a material having improved daylight stability as compared to materials derived from TLP's hydrofinished over conventional hydrofinishing catalysts.

EXAMPLE 6

The 600N slack wax isomerate (TLP), feed D, was hydrofinished over Pt on alumina (1% Cl), Catalyst A, (previously described), under the conditions recited below. The hydrofinished isomerate was fractionated to obtain the 370° C.+ fraction for segment dewaxing to −21° C. pour using 100% MIBK solvent at 4/1 solvent to oil dilution ratio and −26° C. filter temperatures to dewax as recited in Example 4. The dewaxed fraction was evaluated for daylight stability (Table 8).

TABLE 8

| | | |
|---|---|---|
| Hydrofinishing Conditions: | | |
| Temperature °C. | 200 | 200 |
| Pressure psi $H_2$ | 1000 | 500 |
| Gas Rate, SCF/B, $H_2$ | 2500 | 2500 |
| Space Velocity v/v/hr | 2.0 | 2.0 |
| Inspection of Hydrofinished dewaxed Oil | | |
| Time to Form a Slight Haze, days | 60 | 60 |

From this it is seen that hydrofinishing a TLP over a platinum on halogenated alumina isomerization catalyst produces a material which exhibits remarkable daylight stability.

EXAMPLE 7

The 600N slack wax isomerate (TLP), feed D, was hydrofinished over $Pt/F\text{-}Al_2O_3$, Catalyst C, conditions recited below. The hydrofinished isomerate was fractioned to obtain the 370° C.+ fraction for segment dewaxing to −21° C. pour using 100% MIBK solvent at 4/1 solvent to oil dilution ratio and −26° C. filter temperature to dewax as recited in Example 4. The dewaxed fraction was evaluated for daylight stability (Table 9).

TABLE 9

| Hydrofinishing Conditions: |
|---|

TABLE 9-continued

| | | | | | | |
|---|---|---|---|---|---|---|
| Temperature °C. | 200 | 220 | 180 | 200 | 150 | 300 |
| Pressure, psi $H_2$ | 1000 | 1000 | 1000 | 500 | 1000 | 1000 |
| Gas Rate, SCF/B, $H_2$ | 2500 | 2500 | 2500 | 2500 | 2500 | 2500 |
| Space Velocity v/v/hr | 2.0 | 2.0 | 2.0 | 2.0 | 2.0 | 2.0 |
| Inspection of Hydrofinished Dewaxed Oil | | | | | | |
| Time to form a Slight Haze, days | 17 | 17 | 17 | 17 | 5 | 7 |
| Time to form a Distinct Haze, days | 48 | 48 | 20 | 20 | 5 | 9 |

From the above it is seen that a window of hydrofinishing conditions exists within which daylight stability of materials made from isomerate total liquid products is maximized. Hydrofinishing at temperatures between about 180° to 300° C. appears to favor improved daylight stability.

EXAMPLE 8

Bright Stock slack wax isomerate (TLP), feed (a) was hydrofinished over Pt/F-$Al_2O_3$, Catalyst B, conditions recited below. The unhydrofinished TLP and the hydrofinished materials were vacuum distilled to produce 460° to 550° C. fractions, then dewaxed. These fractions were dewaxed with 5% toluene/95% MIBK at a solvent oil ratio of 4:1 and a filter temperature of −27° C. Each dewaxed fraction was then evaluated for daylight stability.

TABLE 10

| Feed | Hydroisomerate(a) | | |
|---|---|---|---|
| Hydrofinishing Conditions | | | |
| Temperature, °C. | — | 200 | 270 |
| Pressure, psi $H_2$ | — | 1000 | 1000 |
| Gas Rate, SCF/B, $H_2$ | — | 5000 | 5000 |
| Space Velocity, v/v/hr | 0.9 | 0.9 | |
| Inspections of Dewaxed Oil (460-550° C. Fraction) | Un-hydrofinished | Hydrofinished | |
| Viscosity at 100° C., cSt | 7.2 | 6.8 | 7.1 |
| Time to Form a Distinct Haze, days | ≦1 | 13 | 10 |

From this it is seen that hydrofinishing at a temperature lower than about 270° C. is preferred for producing daylight stable base oil products from TLP's.

EXAMPLE 9

Bright Stock slack wax isomerate TLP, feed (c), was hydrofinished over Pt/F-$Al_2O_3$, Catalyst B, at conditions recited below. The hydrofinished materials were vacuum distilled to produce heart-cut fractions boiling in the 370° to 580° C. range. These fractions were dewaxed with 100% MIBK using a solvent:oil ratio of 4:1 and a filter temperature of −30° C. The dewaxed heart-cut fractions were then further fractionated into light (4.5 cSt) and heavy (8.4 cSt) dewaxed oil fractions as shown in Table 11 and evaluated for daylight stability.

TABLE 11

| Hydrofinishing Conditions: | | |
|---|---|---|
| Temperature, °C. | 200 | 200 |
| Pressure, psi, $H_2$ | 1000 | 1000 |
| Gas Rate, SCF/B, $H_2$ | 5000 | 2274 |
| Space Velocity v/v/hr | 0.9 | 2.0 |

TABLE 11-continued

| | | | | |
|---|---|---|---|---|
| Inspections of Dewaxed Oil | | | | |
| Boiling Range, °C. | 417 to 460 | 460+ | 435 to 460 | 460+ |
| Viscosity at 100° C. cSt | 4.5 | 8.4 | 4.5 | 8.4 |
| Pour Point, °C. | −27 | −24 | −33 | −30 |
| Time to Form a Distinct Haze, days | 12 | 10 | 11 | 11 |

From the above examples, it is clear that hydrofinishing the total liquid products coming from the isomerization unit using the Group VIII metal on refractory metal oxide or Group VIII metal on halogenated refractory metal oxide catalyst produce dewaxed base oils which exhibit superior daylight stability as compared to the unhydrofinished dewaxed base oils and dewaxed base oils hydrofinished using conventional hydrofinishing catalyst. The examples show that hydrofinishing must be performed within a narrow window of temperature conditions, i.e. about 170°-270° C., preferably 180°-220° C. when operating under consistent mild pressure, treat gas rate and flow velocity conditions.

COMPARATIVE EXAMPLE 1

The following example demonstrates the effect of mild condition hydrofinishing on a fractionated lube hydrocrackate.

A hydrocracked lube basestock was prepared as follows:

Recycle from a fuels hydrocracker was withdrawn with the hydrocracker operating at the following conditions:

| | |
|---|---|
| Feed | Heavy Coker Gas Oil |
| Fresh Feed Rate, kB/D | 11.2 |
| Conversion, Wt. % | 90 6 |
| Recycle Withdrawal, kB/D | 1.05 |
| Reactor 1 temperature, °C. | 401.6 |
| Reactor 2 temperature, °C. | 376.5 |
| Total Pressure, psi | 2100 |

This recycle was fractionated to give a lube stream in 26.3 LV % yield. The lube distillate was solvent dewaxed using a 40/60 mixture of MEK/MIBK, solvent to oil ratio of 2/1, and a filter temperature of −22° C. The resulting dewaxed oil had the following properties:

| | |
|---|---|
| Viscosity at 40° C. cSt | 13.44 |
| Viscosity Index | 109 |
| Saturates, Wt. % | 96.0 |

This basestock has excellent viscometric properties. A sample of this basestock was hydrofinished over a conventional sulphided Ni/Mo on $Al_2O_3$ catalyst (KF-840) at 300° C., 2.0 LHSV, 350 psi $H_2$, 500 SCF/B, $H_2$, treat gas rate. A similar sample of fractionated hydrocrackate was hydrofinished according to the invention over a Pt/F/$Al_2O_3$ catalyst (Catalyst B) at 200° C., 1.0 LHSV, 1000 psi $H_2$ and 5000 SCF/bbl treat gas rate. These three different oils were tested for daylight stability by two different methods. In method 1 a 5 ml vial was three-quarters filled with sample, loosely plugged with cotton wool, exposed to daylight in a north-facing window, and checked daily when possible for appearance. In method 2 oil samples (again in a 5 ml vial plugged with cotton wool) were exposed continuously in a light box apparatus in which the lamp used Excella fluorescent tube from Sunburst Electric) simulates the intensity and frequency range of actual radiation. Samples were rated daily in terms of time to haze, floc and sludge.

The results are presented in Table 12.

TABLE 12

| | Unhydro-finished | Conventional Hydro-finishing | Mild Hydro-finishing |
|---|---|---|---|
| Test Method 1 (North Window) | | | |
| Time to Light Sludge (days) | 5 | 12 | >16 days |
| Time to Heavy Sludge (days) | 12 | — | — |
| Appearance of light sludge or haze indicates the sample has failed. The oil treated according to the present invention as clear and white after 16 days, indicating excellent stability in this test. The unhydrofinished and conventionally hydrofinished oils produced sludge in an unacceptably short period of time. | | | |
| Test Method 2 (Light Box) | | | |
| Time to Light Haze (hours) | 24 | 48 | 120 |
| Time to Light Sludge (hours) | 48 | 55 | 169 |
| Time to Heavy Sludge (hours) | 120 | 120 | 288 |
| Again, the oil hydrofinished over the $Pt/F/Al_2O_3$ catalyst at low temperatures is considerably improved in daylight stability compared with conventional hydrofinishing and unfinished oil. | | | |

From this it is apparent that mild hydrofinishing of hydrocrackate fractions produces base oil materials which exhibit improved daylight stability.

COMPARATIVE EXAMPLE 2

An experiment was conducted to determine the effect of practicing mild hydrofining on a total liquid product hydrocrackate. In this example the feed, the total liquid product hydrocrackate is the recycle from the fuels hydrocracker described in Comparative Example 1. A portion of this stream, without fractionation was passed over Catalyst D at 200° C., 1.0 LHSV 1000 psi $H_2$ and 5000 SCF/bbl, $H_2$, while a second portion was treated conventionally using KF-840 under the conditions recited in Comparative Example 1. These materials were then fractionated and dewaxed to produce lube oil products which were evaluated for daylight stability using the light box procedure recited in Comparative Example 1. The results are presented in Table 13.

TABLE 13

| | Test Method 2 (Light Box) | | |
|---|---|---|---|
| | Unhydro-finished | Conventional Hydrofinishing as a TLP | Mild Hydro-finishing as a TLP |
| Time to Light Haze (hours) | 18 | 18 | 45 |
| Time to Light Sludge (hours) | 32 | 32 | 54 |
| Time to Heavy Sludge (hours) | 54 | 79 | 97 |

While it is seen that mild hydrofinishing of the TLP hydrocrackate improves the daylight stability of a base oil produced from said material to some extent as compared to conventional hydrofinishing, it is clear that the level of improvement is not such as to significantly alter the behavioral properties of the oil.

This example does show, however, that the improvements to daylight observed for wax isomerate TLP resulting from mild hydrorefining are significant and unexpected.

We claim:

1. A method for improving the daylight stability of a lube oil base stock or blending stock produced by the isomerization of slack wax containing from 0% to 25% oil coming from the dewaxing of conventional petroleum crude oils, said method comprising hydrorefining the total liquid product produced in the petroleum slack wax isomerization unit said hydrorefining being practiced under mild conditions said conditions including a temperature of 170° to 270° C., a flow velocity of 0.25 to 10 v/v/hr., a pressure of 300 to 1500 psi $H_2$, and a hydrogen gas rate of 500 to 10,000 SCF $H_2$/bbl using a Group VIII metal on halogenated refractory metal oxide catalyst.

2. The method of claim 1 wherein the mildly hydrorefined total liquid product is fractionated to yield a lube oil fraction and dewaxing said lube oil fraction.

3. The method of claim 2 wherein the mild hydrorefining step is run at a temperature of 180° to 220° C., a flow velocity of 1 to 4 v/v/hr., a pressure of 500 to 1000 psi $H_2$ and a hydrogen gas rate of 1000 to 5000 SCF/B.

4. The method of claims 1 or 2 wherein the catalyst used in the mild hydrorefining step is platinum or palladium on fluorided or chlorinated silica, silica/alumina or alumina.

5. The method of claims 1 or 2 wherein the catalyst used in the mild hydrorefining step is platinum or palladium on fluorided or chlorinated silica, silica/alumina or alumina.

6. The method of claim 5 wherein the catalyst is platinum on fluorided transition alumina.

* * * * *